US010100996B2

(12) United States Patent
Hu

(10) Patent No.: US 10,100,996 B2
(45) Date of Patent: Oct. 16, 2018

(54) LIGHT PATTERNING DEVICE AND ILLUMINATING AND/OR SIGNALING APPARATUS

(71) Applicant: Valeo Lighting Hubei Technical Center Co., Ltd., Wuhan, Hubei (CN)

(72) Inventor: Qiang Hu, Hubei (CN)

(73) Assignee: Valeo Lighting Hubei Technical Center Co., Ltd., Wuhan (CN)

( * ) Notice: Subject to any disclaimer, the term of this patent is extended or adjusted under 35 U.S.C. 154(b) by 0 days.

(21) Appl. No.: 15/318,806

(22) PCT Filed: Jun. 15, 2015

(86) PCT No.: PCT/CN2015/081438
§ 371 (c)(1),
(2) Date: Dec. 14, 2016

(87) PCT Pub. No.: WO2015/192747
PCT Pub. Date: Dec. 23, 2015

(65) Prior Publication Data

US 2017/0130925 A1 May 11, 2017

(30) Foreign Application Priority Data

Jun. 16, 2014 (CN) ..... 2014 1 0266767

(51) Int. Cl.
*F21S 41/20* (2018.01)
*F21S 41/32* (2018.01)
(Continued)

(52) U.S. Cl.
CPC ..... *F21S 41/322* (2018.01); *F21S 43/315* (2018.01); *F21S 48/1329* (2013.01);
(Continued)

(58) Field of Classification Search
CPC ..... F21S 48/1329; F21S 48/234; F21S 41/20; F21S 41/24; F21S 43/235; F21S 43/236; F21S 43/241; F21S 43/243
See application file for complete search history.

(56) References Cited

U.S. PATENT DOCUMENTS 6,099,156 A * 8/2000 Jenkins ..... B29C 45/561 362/21
7,926,995 B2 * 4/2011 Forrester ..... G02B 6/003 362/555
8,573,822 B2 * 11/2013 Ishihara ..... F21S 48/215 362/240
8,579,485 B2 * 11/2013 Hara ..... F21S 48/215 362/327
(Continued)

FOREIGN PATENT DOCUMENTS

CN 1929157 A 3/2007
CN 101365909 A 2/2009
(Continued)

OTHER PUBLICATIONS

"International Application No. PCT/CN2015/081438, International Search Report dated Sep. 22, 2015", (Sep. 22, 2015), 5 pgs.
(Continued)

*Primary Examiner* — Anabel Ton
(74) *Attorney, Agent, or Firm* — Oblon, McClelland, Maier & Neustadt, L.L.P.

(57) ABSTRACT

A light patterning device and an illuminating and/or signaling apparatus are provided. The light patterning device (100) comprises: a light incidence portion for receiving an incident light (10, 14); a first reflective wall (2) having a first reflective area (21); and a second reflective wall (3) being provided with a light transmission area (32) at least partly transmitting the light from the light incidence portion (1) or the first reflective area (21) out of the light patterning device (100) so as to form a bright region and a second reflective area (31) at least partly reflecting the light towards the first reflective area (21) so as to form a dark region, the first
(Continued)

200 reflective area (21) at least partly reflecting the light from the second reflective area (31) towards the second reflective wall (3).

19 Claims, 3 Drawing Sheets

(51) Int. Cl.
*F21S 8/10* (2006.01)
*F21S 43/31* (2018.01)
*F21S 43/236* (2018.01)

(52) U.S. Cl.
CPC ..... *F21S 48/236* (2013.01); *F21S 41/20* (2018.01); *F21S 43/236* (2018.01)

(56) References Cited

U.S. PATENT DOCUMENTS

| | | | | |
|---|---|---|---|---|
| 9,316,378 | B2 * | 4/2016 | Ebner | F21V 5/007 |
| 2012/0106190 | A1 * | 5/2012 | Ben-Levy | F21V 7/0091 362/551 |

FOREIGN PATENT DOCUMENTS

| | | | |
|---|---|---|---|
| CN | 201293252 | Y | 8/2009 |
| CN | 102007608 | A | 4/2011 |
| CN | 102563534 | A | 7/2012 |
| JP | 2001266609 | A | 9/2001 |

OTHER PUBLICATIONS

"International Application No. PCT/CN2015/081438, Written Opinion dated Sep. 22, 2015", (Sep. 22, 2016), 4 pgs.

* cited by examiner

LIGHT PATTERNING DEVICE AND ILLUMINATING AND/OR SIGNALING APPARATUS

CROSS-REFERENCE TO RELATED APPLICATION

This application is a U.S. National Stage Filing under 35 U.S.C. 371 from International Application No. PCT/CN2015/081438, filed on 15 Jun. 2015, and published as WO2015/192747 on Dec. 23, 2015, which claims the benefit of Chinese Patent Application No. 201410266767.9 filed on Jun. 16, 2014 in the State Intellectual Property Office of China, which applications and publication are incorporated herein by reference in their entirety.

BACKGROUND OF THE INVENTION

Field of the Invention

The present disclosure relates to a light illuminating and signaling field, in particular, a light patterning device and an illuminating and/or signaling apparatus including the same.

Description of the Related Art

In a light illuminating or signaling application, customized requirements become more and more, and may need special light effects. For example, it may need to increase depth of field to form multilevel three dimensional optical effects. In particular, it may be desired that the illuminating or signaling light contains certain information or patterns to meet the customized requirements. However, in the conventional light illuminating or signaling apparatus, in particular, in a vehicle lamp for an automobile vehicle, there is no means for patterning the illuminating or signaling light. Therefore, it is desired to provide a device for patterning light, which can be integrated in the light illuminating or signaling apparatus, for example in a lamp.

SUMMARY OF THE INVENTION

An object of the present invention is to provide a light patterning device that can pattern the illuminating and/or signaling light by forming distinct bright and dark regions by reflective areas and light transmission areas on a reflective wall.

Another object of the present invention is to provide an illuminating and/or signaling apparatus which has the light patterning device and can achieve customized light effects.

An embodiment of the present invention provides light patterning device, comprising:

a light incidence portion located at a central position of the light patterning device at a first side thereof and configured to receive an incident light;

a first reflective wall adjoining the light incidence portion and extending towards a periphery of the light patterning device from the light incidence portion along the first side of the light patterning device, the first reflective wall having a first reflective area; and a second reflective wall located at a second side opposed to the first side of the light patterning device and configured to be opposed to the light incidence portion and the first reflective wall, wherein the second reflective wall is provided with a light transmission area which is configured to at least partly transmit the light from the light incidence portion or the first reflective area out of the light patterning device so as to form a bright region and a second reflective area which is configured to at least partly reflect the light from the light incidence portion or the first reflective area towards the first reflective area of the first reflective wall so as to form a dark region, the first reflective area of the first reflective wall at least partly reflecting the light from the second reflective area of the second reflective wall towards the second reflective wall.

In an embodiment, the first reflective area of the first reflective wall and the second reflective area of the second reflective wall are oriented such that the light reflected between the first reflective area and the second reflective area in the light pattering device is directed gradually towards the periphery of the light patterning device.

In an embodiment, the first reflective area and the second reflective area are oriented such that the reflection of light at the first reflective area and the second reflective area meets the condition of total reflection.

In an embodiment, the light patterning device is a solid component in one piece.

In an embodiment, the light transmission area comprises a protrusion projecting towards the external of the light patterning device to form a pattern.

In an embodiment, the light transmission area comprises a light transmission ring at a peripheral position of the light patterning device or near the peripheral position thereof.

In an embodiment, an angle of inclination of the first reflective area and the second reflective area with respect to a central axis of the light patterning device is between 40 degrees and 50 degrees.

In an embodiment, the angle of inclination of the first reflective area and the second reflective area with respect to the central axis of the light patterning device is about 45 degrees.

In an embodiment, the light incidence portion is provided with a collimator configured to collimate the incident light.

In an embodiment, the first reflective wall is provided with at least two first reflective areas and a first spacing area for spacing adjacent first reflective areas from each other and that the second reflective wall is provided with at least two second reflective areas and a second spacing area for spacing adjacent second reflective areas from each other, wherein the first spacing area and the second spacing area extend substantially in a direction parallel to a central axis of the light patterning device.

An embodiment of the present invention provides an illuminating and/or signaling apparatus, comprising:

a light patterning device as described above; and a light source configured to supply the light to the light incidence portion.

In an embodiment, the light source is located in the central axis of the light patterning device and outside of the first side of the light patterning device.

At least one above embodiments of the present invention can pattern an incident light by a reflective wall arrangement provided with light transmission areas and reflective areas. The light patterning device and the illumination and/or signaling apparatus according to the above embodiments may impart the illuminating and/or signaling light with customized pattern and information.

DETAILED DESCRIPTION OF PREFERRED EMBODIMENTS

The embodiments of the present invention will be further explained below with reference to the figures and examples. Throughout the description, same or similar reference numbers indicate the same or similar members. The following embodiments along with the figures are only used to explain the general concept of the present invention, instead of being intended to limit the scope of the present invention.

Figure 1:
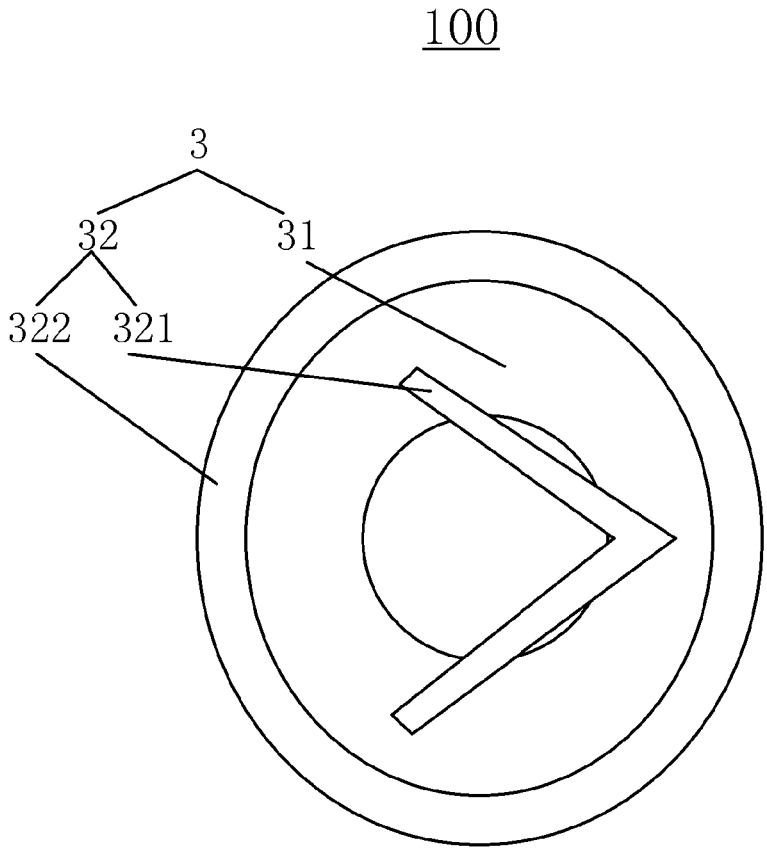
FIG. 1 is a front view schematically showing a light patterning device according to an embodiment of the present invention.
Figure 2:
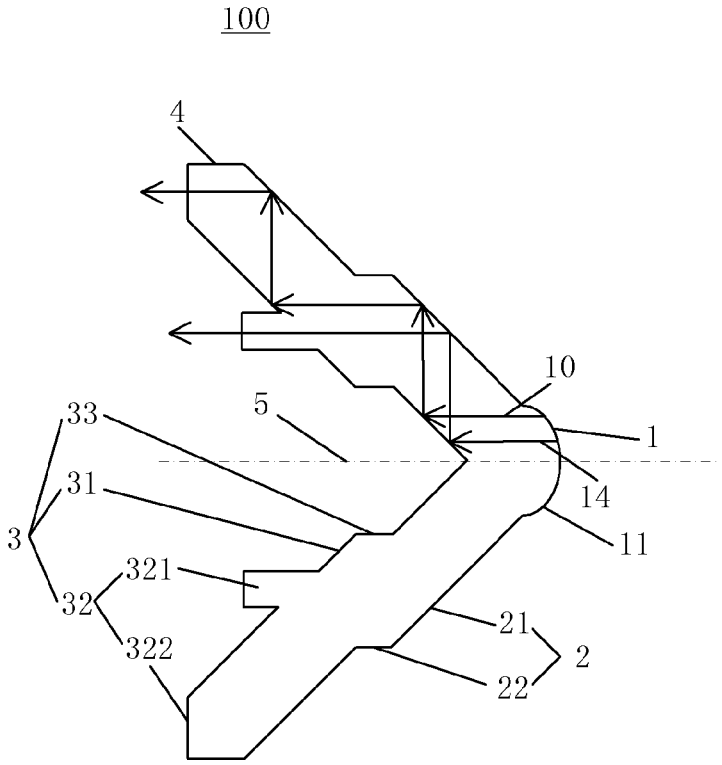
FIG. 2 is a side sectional view schematically showing a light patterning device according to an embodiment of the present invention.

FIGS. 1-2 schematically show a light patterning device 100 according to an embodiment of the present invention. The light patterning device 100 comprises: a light incidence portion 1, a first reflective wall 2 and a second reflective wall 3. As illustrated in FIG. 2, the light incidence portion 1 is located at a central position of the light patterning device 100 at a first side thereof and configured to receive an incident light 10. The first reflective wall 2 adjoins the light incidence portion 1 and extends towards a periphery 4 of the light patterning device 100 from the light incidence portion 1 along the first side (i.e., right side in FIG. 2) of the light patterning device 100. The second reflective wall 3 is located at a second side (i.e., left side in FIG. 2) opposed to the first side of the light patterning device 100 and configured to be opposed to the light incidence portion 1 and the first reflective wall 2. The first reflective wall 2 has a first reflective area 21. The second reflective wall 3 is provided with a light transmission area 32 and a second reflective area 31. The light transmission area 32 is configured to at least partly transmit the light from the light incidence portion 1 or the first reflective area 21 (e.g. reflected by the first reflective area 21) of the first reflective wall 2 out of the light patterning device 100 so as to form a bright region. The second reflective area 31 is configured to at least partly reflect the light from the light incidence portion 1 or the first reflective area 21 towards the first reflective area 21 so as to form a dark region. The first reflective area 21 of the first reflective wall 2 at least partly reflects the light from the second reflective area 31 of the second reflective wall 3 towards the second reflective wall 3. In the above example, the first reflective area 21 and the second reflective area 31 may reflect the light completely or partly.

In the light patterning device 100 according to the present disclosure, the incident light from the light incidence portion 1 is conducted in the light patterning device 100 while it is reflected between the first reflective area 21 of the first reflective wall 2 and the second reflective area 31 of the second reflective wall 3. The second reflective wall 3 functions to pattern the light and thus may be regarded as a patterning wall. The second reflective wall 3 is provided with the light transmission area 32 and the second reflective area 31. When viewed from the second side (e.g. left side in FIG. 2) of the light patterning device 100, the light transmitted through the light transmission area 32 will form the bright region while the second reflective area 31 reflects the light back to the first reflective area 21 to prevent the light from being transmitted so as to form the dark region. This contrast between the bright region and the dark region may form a desired pattern, for example, a letter or number (the letter V is shown in FIG. 1), a geometric figure, a line drawing, a two dimensional code, or the like. These patterns may be ornamental, or may have indicating information, for example, it may indicate "stop", "warning", and so on.

In an example, the first reflective area 21 of the first reflective wall 2 and the second reflective area 31 of the second reflective wall 3 are oriented such that the light reflected between the first reflective area 21 and the second reflective area 31 is directed in the light patterning device 100 gradually towards the periphery 4 of the light patterning device 100. For example, as shown in FIG. 2, the first reflective area 21 and the second reflective area 31 are both inclined at a certain angle with respect to the incident light 10. Thus, the incident light 10 is transmitted through a light transmission area at an outer periphery of the second reflective wall 3 after being reflected by the first reflective area 21 twice and the second reflective area 31 twice respectively. Another incident light 14 is transmitted through another light transmission area of the second reflective wall 3 after being reflected by the first reflective area 21 once and the second reflective area 31 once respectively.

As an example, the first reflective area 21 and the second reflective area 31 may be oriented such that the reflection of light at the first reflective area 21 and the second reflective area 31 meets the condition of total reflection. For example, the first reflective area 21 and the second reflective area 31 are inclined at an angle between 40 degrees and 50 degrees, preferably about 45 degrees, with respect to a central axis 5 of the light patterning device 100. By means of the total reflection, the optical efficiency may be significantly improved and the optical loss may be reduced. In this way, the above contrast between the dark region and bright region can be improved to achieve clearer patterns while avoiding heat generation and reduction of power consumption. It should be noted that the light patterning device 100 according to an embodiment of the present invention may also be implemented by other means except the total reflection, for example, by providing another reflective layer such as a metal reflective layer.

In an example shown in FIGS. 1-2, two examples of the light transmission area 32 are given, i.e., a protrusion 321 projecting towards the external of the light patterning device 100 and a light transmission ring 322 at a peripheral position of the light patterning device 100 or near the peripheral position thereof. The protrusion 321 may form various simple or complex patterns. The light transmission ring 322 may provide a clear boundary between the pattern and a surrounding background. However, it is not necessary. The specific forms of the light transmission area 32 may be designed as required.

As an example, the light patterning device 100 may be a solid component in one piece. For example, it may be made from transparent materials such as resin, plastics, and glass. In this way, the light patterning device 100 may achieve a more compact structure and facilitate the manufacturing.

In an example, the light incidence portion 1 is provided with a collimator 11 configured to collimate the incident light 10. Collimation to the incident light contributes to controlling the optical path of the light in the light patterning device 100 in design. Certainly, it is not necessary, for example, if the incident light has been collimated itself, the collimator 11 may not be provided. Further, it is not necessary for the incident light to be collimated. For the uncollimated incident light, the function for patterning may also be achieved basically by reasonable design of parameters of the first reflective wall 2 and the second reflective wall 3.

In an example, the first reflective wall 2 may be provided with at least two first reflective areas 21 and a first spacing area 22 for spacing adjacent first reflective areas 21 from each other. Correspondingly, the second reflective wall 3 may also be provided with at least two second reflective areas 31 and a second spacing area 33 for spacing adjacent second reflective areas 31 from each other. The first spacing area 22 and the second spacing area 33 may be arranged such that the axial length of the light patterning device 100 is prolonged while keeping the radial length (for example diameter) of the light patterning device 100, in order to increase the optical path of the light in the light patterning device 100. In this way, it may improve visual depth of the light transmitted through the light transmission area 32 to improve the light effects. As an example, the first spacing area 22 and the second spacing area 33 extend substantially in a direction parallel to the central axis 5 of the light patterning device 100.

The light patterning device 100 according to an embodiment of the present invention may be conveniently provided in the conventional all kinds of illuminating and/or signaling apparatus, for example, headlamp, rear lamp, stop lamp or the like, for an automobile vehicle.

Figure 3:
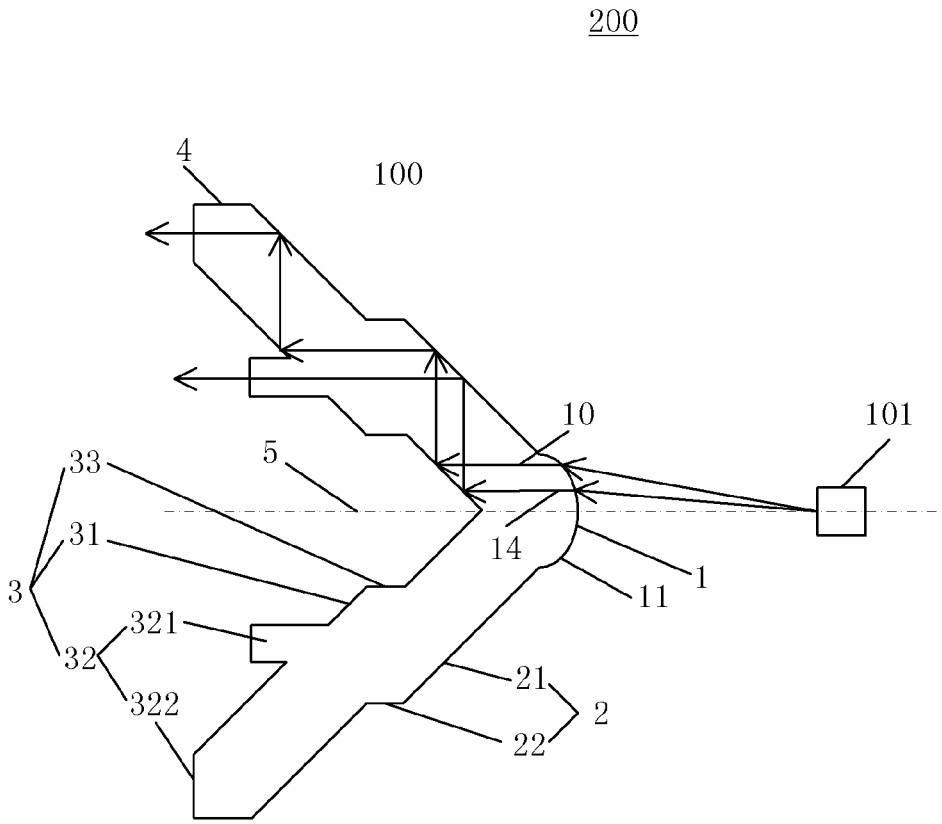
FIG. 3 shows schematically an illumination and/or signaling apparatus according to an embodiment of the present invention.

An embodiment of the present invention also provides an illuminating and/or signaling apparatus 200. As illustrated in FIG. 3, the illuminating and/or signaling apparatus 200 comprises a light patterning device 100 as described in any one of the above embodiments and a light source 101. The light source 101 is configured to supply the light to the light incidence portion 1. In an example, the light source 101 may be located at the central axis 5 of the light patterning device 100 and located outside of the first side of the light patterning device 100, as illustrated in FIG. 3. It contributes to uniform and symmetrical light distribution for the light patterning device 100. The illuminating and/or signaling apparatus 200 may for example be used for such as LED illumination apparatus, incandescent or florescent lamp illumination apparatus.

The illuminating and/or signaling apparatus according to an embodiment of the present invention may be used for illumination and signaling of the vehicle, or may be used widely in other illumination and/or signaling field, for example, an electric torch or a light reflective plate for photographing.

Although the present disclosure is provided with reference to figures, all of the embodiments shown in figures are intended to explain the preferred embodiments of the present invention by ways of examples, instead of being intended to limit the present invention.

Apparently, it would be appreciated by those skilled in the art that various changes or modifications may be made in the present disclosure without departing from the principles and spirit of the disclosure, which are intended to be covered by the present invention as long as these changes or modifications fall within the scope defined in the claims and their equivalents.

What is claimed is:

1. A light patterning device, comprising:

a light incidence portion located at a central position of the light patterning device at a first side thereof and configured to receive an incident light;

a first reflective wall adjoining the light incidence portion and extending towards a periphery of the light patterning device from the light incidence portion along the first side of the light patterning device, the first reflective wall having a first reflective area; and a second reflective wall located at a second side opposed to the first side of the light patterning device and configured to be opposed to the light incidence portion and the first reflective wall, wherein the second reflective wall is provided with a light transmission area which is configured to at least partly transmit the light from the light incidence portion or the first reflective area out of the light patterning device so as to form a bright region and a second reflective area which is configured to at least partly reflect the light from the light incidence portion or the first reflective area towards the first reflective area of the first reflective wall so as to form a dark region, the first reflective area of the first reflective wall at least partly reflecting the light from the second reflective area of the second reflective wall towards the second reflective wall, wherein the light transmission area comprises a protrusion projecting towards the external of the light patterning device to form a pattern.

2. The light patterning device according to claim 1, wherein the first reflective area of the first reflective wall and the second reflective area of the second reflective wall are oriented such that the light reflected between the first reflective area and the second reflective area in the light patterning device is directed gradually towards the periphery of the light patterning device.

3. The light patterning device according to claim 2, wherein the first reflective area and the second reflective area are oriented such that the reflection of light at the first reflective area and the second reflective area meets the condition of total reflection.

4. The light patterning device according to claim 3, wherein the light patterning device is a solid component in one piece.

5. The light patterning device according to claim 1, wherein the light transmission area comprises a light transmission ring at a peripheral position of the light patterning device or near the peripheral position thereof.

6. The light patterning device according to claim 1, wherein an angle of inclination of the first reflective area and the second reflective area with respect to a central axis of the light patterning device is between 40 degrees and 50 degrees.

7. The light patterning device according to claim 6, wherein the angle of inclination of the first reflective area and the second reflective area with respect to the central axis of the light patterning device is about 45 degrees.

8. The light patterning device according to claim 1, wherein the light incidence portion is provided with a collimator configured to collimate the incident light.

9. The light patterning device according to claim 1, wherein the first reflective wall is provided with at least two first reflective areas and a first spacing area for spacing adjacent first reflective areas from each other and that the second reflective wall is provided with at least two second reflective areas and a second spacing area for spacing adjacent second reflective areas from each other, wherein the first spacing area and the second spacing area extend substantially in a direction parallel to a central axis of the light patterning device.

10. An illuminating and/or signaling apparatus, comprising:

a light patterning device according to claim 1; and a light source configured to supply the light to the light incidence portion.

11. The illuminating and/or signaling apparatus according to claim 10, wherein the light source is located in the central axis of the light patterning device and outside of the first side of the light patterning device.

12. The light patterning device according to claim 2, wherein the light transmission area comprises a protrusion projecting towards the external of the light patterning device to form a pattern.

13. The light patterning device according to claim 3, wherein the light transmission area comprises a protrusion projecting towards the external of the light patterning device to form a pattern.

14. The light patterning device according to claim 4, wherein the light transmission area comprises a protrusion projecting towards the external of the light patterning device to form a pattern.

15. The light patterning device according to claim 2, wherein the light transmission area comprises a light transmission ring at a peripheral position of the light patterning device or near the peripheral position thereof.

16. The light patterning device according to claim 3, wherein the light transmission area comprises a light transmission ring at a peripheral position of the light patterning device or near the peripheral position thereof.

17. The light patterning device according to claim 4, wherein the light transmission area comprises a light transmission ring at a peripheral position of the light patterning device or near the peripheral position thereof.

18. The light patterning device according to claim 3, wherein the first reflective wall is provided with at least two first reflective areas and a first spacing area for spacing adjacent first reflective areas from each other and that the second reflective wall is provided with at least two second reflective areas and a second spacing area for spacing adjacent second reflective areas from each other, wherein the first spacing area and the second spacing area extend substantially in a direction parallel to a central axis of the light patterning device.

19. The light patterning device according to claim 4, wherein the first reflective wall is provided with at least two first reflective areas and a first spacing area for spacing adjacent first reflective areas from each other and that the second reflective wall is provided with at least two second reflective areas and a second spacing area for spacing adjacent second reflective areas from each other, wherein the first spacing area and the second spacing area extend substantially in a direction parallel to a central axis of the light patterning device.

* * * * *